US006101860A

United States Patent [19]

Wu

[11] Patent Number: 6,101,860

[45] Date of Patent: Aug. 15, 2000

[54] SHAPING DEVICE OF A WIRE BENDING MACHINE

[76] Inventor: David Wu, No. 21, Alley 9, Lane 27, Sec. 5, Min Sheng E. Rd., Taipei, Taiwan

[21] Appl. No.: 09/360,082

[22] Filed: Jul. 22, 1999

[51] Int. Cl.[7] ..... B21J 13/04; B21F 1/00

[52] U.S. Cl. ..... 72/402; 72/403; 72/446; 72/452.5; 72/456

[58] Field of Search ..... 72/472, 402, 403, 72/452.5, 446, 447, 449, 456

[56] References Cited

U.S. PATENT DOCUMENTS

| | | | |
|---|---|---|---|
| 2,562,644 | 7/1951 | Saxer | 72/402 |
| 3,296,851 | 1/1967 | Breuer | 72/403 |
| 4,862,717 | 9/1989 | Dolliner | 72/403 |
| 5,209,101 | 5/1993 | Finzer | 72/449 |
| 5,216,913 | 6/1993 | Post | 72/446 |
| 5,542,283 | 8/1996 | Post | 72/446 |
| 5,836,195 | 11/1998 | Wu | 72/403 |

FOREIGN PATENT DOCUMENTS

| | | | |
|---|---|---|---|
| 2-70348 | 3/1990 | Japan | 72/452.5 |

*Primary Examiner*—David Jones
*Attorney, Agent, or Firm*—Rosenberg, Klein & Lee

[57] ABSTRACT

A shaping device of a wire bending machine formed by a plurality of shaping means, each shaping means comprises a seat, a motor, a rotary wheel, a linkage and a knife seat. The seat is fixed to the wire bending machine, and is installed with a track. The motor is fixed to the seat. The rotary wheel is connected to the motor and is driven to rotate by the motor. One end of the linkage is pivotally connected to an eccentric position of the rotary wheel. The knife seat is slidably matched to the track of the seat, while another end of the linkage is pivotally to the knife seat. By aforementioned components, a shaping device of a wire bending machine with a large stroke and a small radius is formed.

4 Claims, 7 Drawing Sheets

PIROR ART

SHAPING DEVICE OF A WIRE BENDING MACHINE

BACKGROUND OF THE INVENTION

1. Field of the Invention

The present invention relates to a shaping device of a wire bending machine, and especially to a shaping device installed in a wire bending machine for driving a knife seat (shaping knife) to move.

2. Description of the Prior Art

A wire bending machine is a machine for bending a wire for shaping a spring, or other components. As shown in FIG. 1, a prior art wire bending machine is installed with a plurality of shaping means 10*a* (only one is shown in the figure). The shaping means 10*a* each has a cam 11*a* driven by a servo motor (not shown). Each side of the cam 11*a* is installed with an arm 12*a* one end of which is pivotally installed with a roller 13*a*. The roller 13*a* is matched to the working curve of the cam 11*a*. When the cam 11*a* rotates, the roller 13*a* will move upwards and downwards with the curve of the cam 11*a* so as to drive the linkage 14*a* at another end of the linkage 14*a*. A shaping knife 16*a* is fixed to the knife seat 15*a*, by the linkage 14*a* to drive the shaping knife 16*a* to move upwards and downwards so that the wire output from the wire output axial center 17*a* is bent by ejection of the shaping knife 16*a*.

However, since in above shaping device of a wire bending machine, the cam 11*a* serves to drive the shaping means 16*a* to move upwards and downwards. Since the stroke of the cam 11*a* is finite, only a stroke smaller than the radius of the cam is used as a finishing length. If the cam 11*a* needs a large stroke, it must be manufactured with a larger size so that the volume of the whole structure will greatly increase. Moreover, a cam needs much material, longer time, and cost. Furthermore, the cam 11*a* and arm 12*a* have complex structure and need a higher precision. Therefore, manufacturing cost is increased greatly.

SUMMARY OF THE INVENTION

Accordingly, the object of the present invention is to provide a shaping device of a wire bending machine formed by a plurality of shaping means, each shaping means comprise a seat, a motor, a rotary wheel, a linkage and a knife seat. A receiving tank and a linkage form as a linkage means so as to drive the shaping knife to move upwards and downwards, which has a stroke almost equal to the diameter of the rotary wheel. The larger stroke has a smaller turning diameter. Thus, only a smaller size is sufficient. Therefore, the whole adjusting means has a smaller volume. Moreover, the defects in the prior art cam, such as material and time consuming, and expensive in cost, are not present in the present invention. Moreover, in the present invention, the rotary wheel and the linkage have simple structures and need lower precision. Therefore, manufacturing cost is lowered.

The present invention will be better understood and its numerous objects and advantages will become apparent to those skilled in the art by referencing to the following drawings in which:

DETAILED DESCRIPTION OF THE PREFERRED EMBODIMENT

Figure 10:
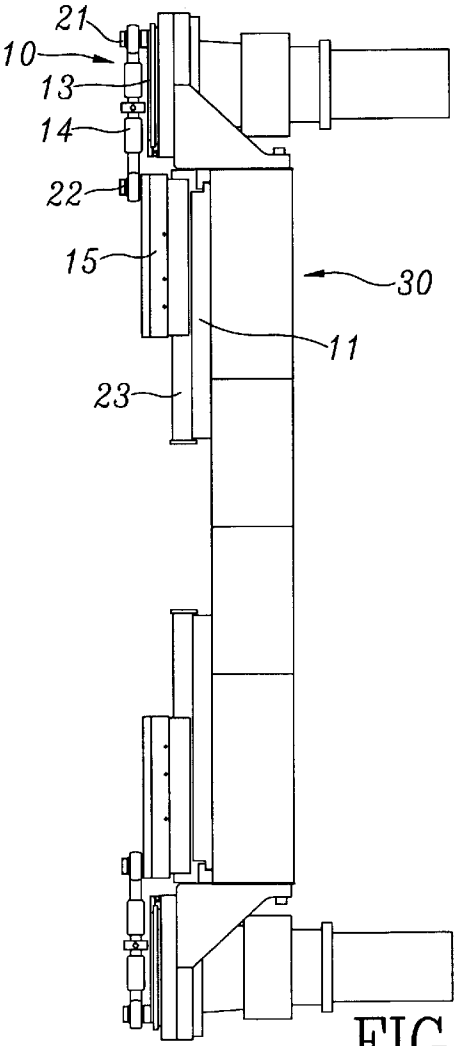
FIG. 10 is a lateral view showing that the present invention is assembled to a wire bending machine.
Figure 9:
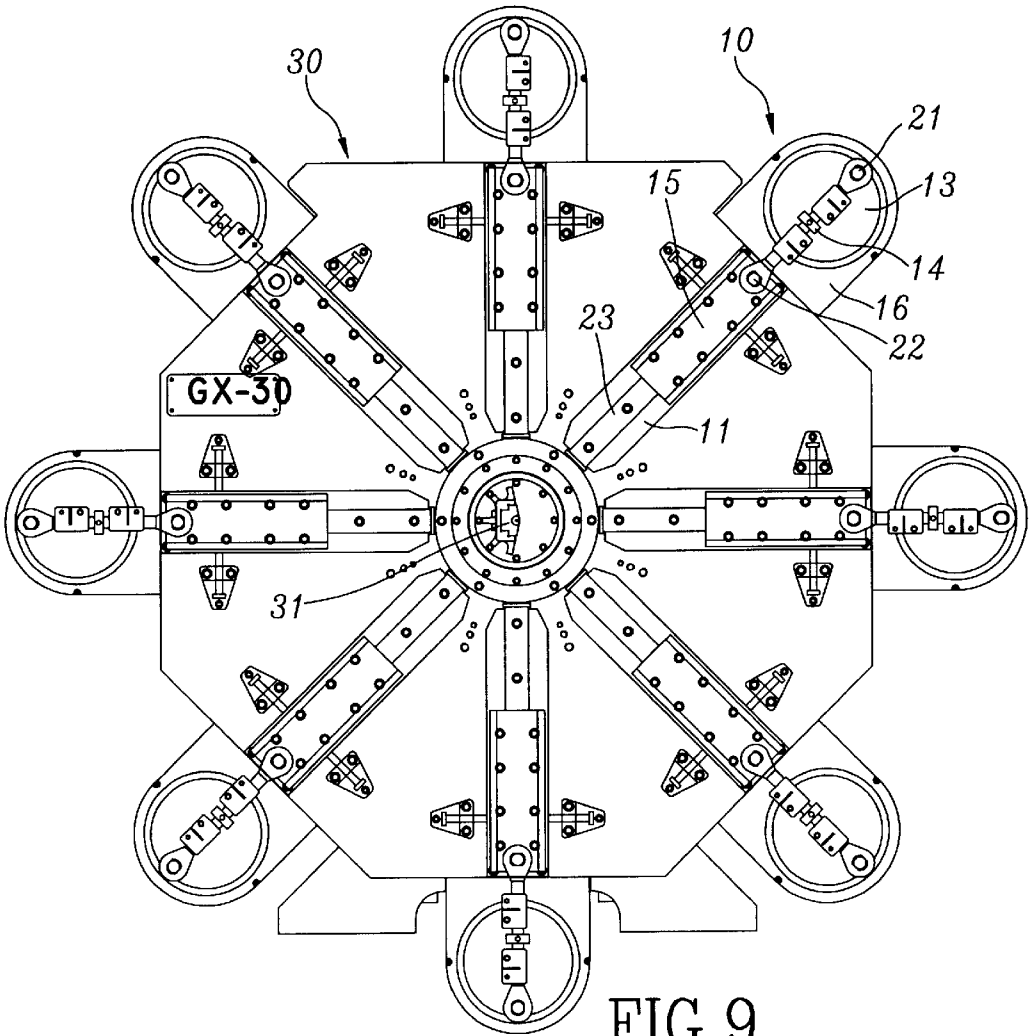
FIG. 9 is a front view showing that the present invention is assembled to a wire bending machine.

With reference to FIGS. 2~6, a shaping device of a wire bending machine of the present invention is illustrated. The wire bending machine is installed with a plurality of shaping means 10 (as shown in FIG. 9 and 10). Each of the shaping means 10 includes a seat 11, a motor 12, a rotary wheel 13, a linkage 14, and a knife seat 15. The seat 11 can be properly fixed to the wire bending machine 30. The motor 12 is also fixed to a motor frame 16. The motor 16 is also fixed to the upper end of the seat 11. A round receiving tank 17 is formed in front of the motor frame 16. The receiving tank 17 is arranged with a bearing seat 18 and a bearing 19 therewithin. The rotary wheel 13 is fixed to the power output shaft 20 of the motor 12. The rotary wheel 13 is driven to rotate by the motor 12. The rotary wheel 13 is in contact with the bearing 19, thus the rotary wheel 13 may rotate smoothly. One end of the linkage 14 is pivotally connected to an eccentric position of the receiving tank 13 by a first pivotally connecting element (stud) 21. Another end of the linkage 14 is pivotally connected to the upper end of the knife seat 15 by a second pivotally connecting element (stud) 22. The linkage 14 is slidably matched with a track 23 vertically installed in front of the seat 11. Thus, the knife seat 15 may slide upwards or downwards along the track 23 of the seat 11. The knife seat 15 can be locked with a shaping knife (not shown) as desired. By aforementioned components, a shaping device of a wire bending machine of the present invention is formed.

Figure 1:
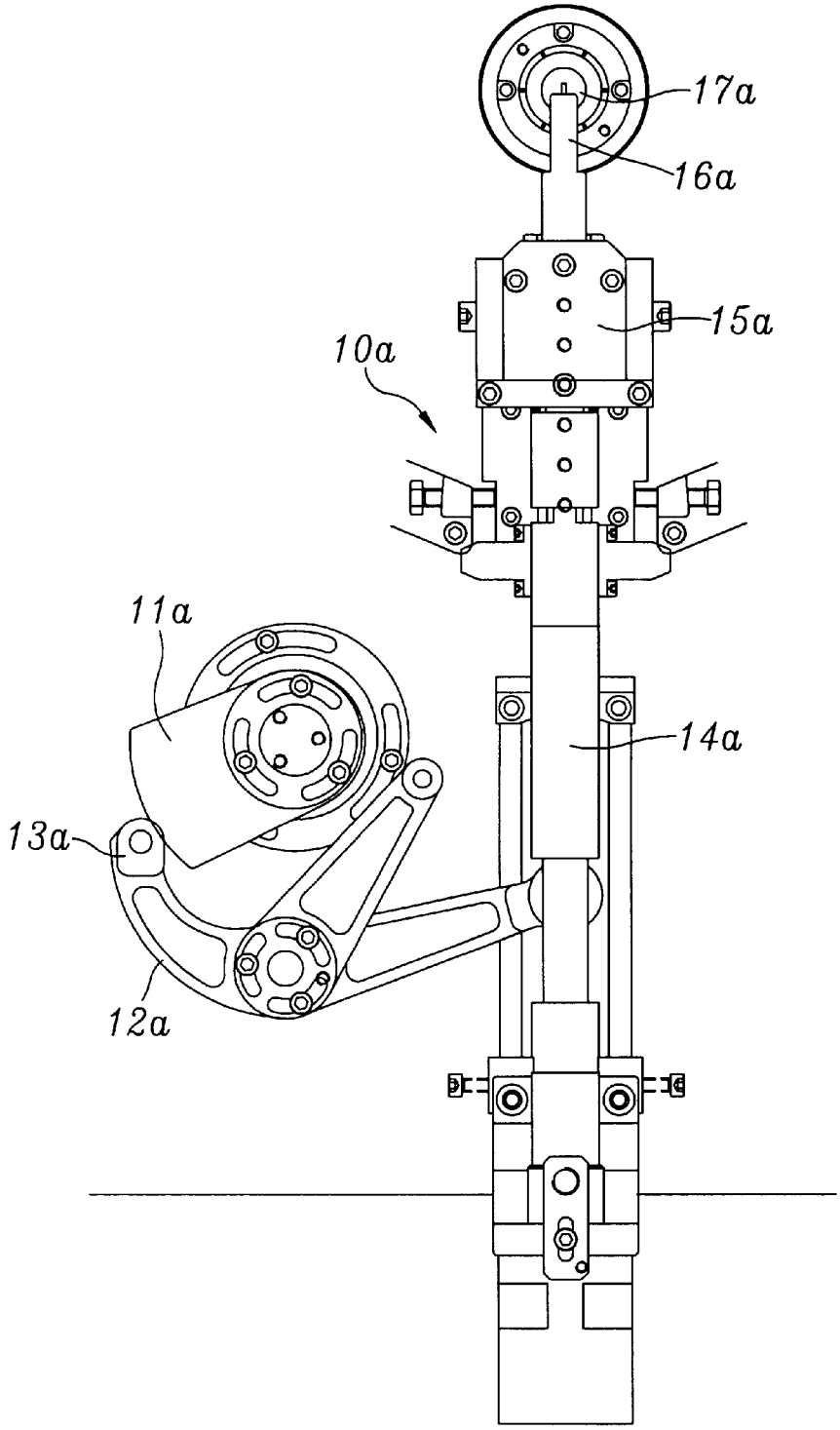
FIG. 1 is a front view showing a prior art shaping device of a wire bending machine.
Figure 2:
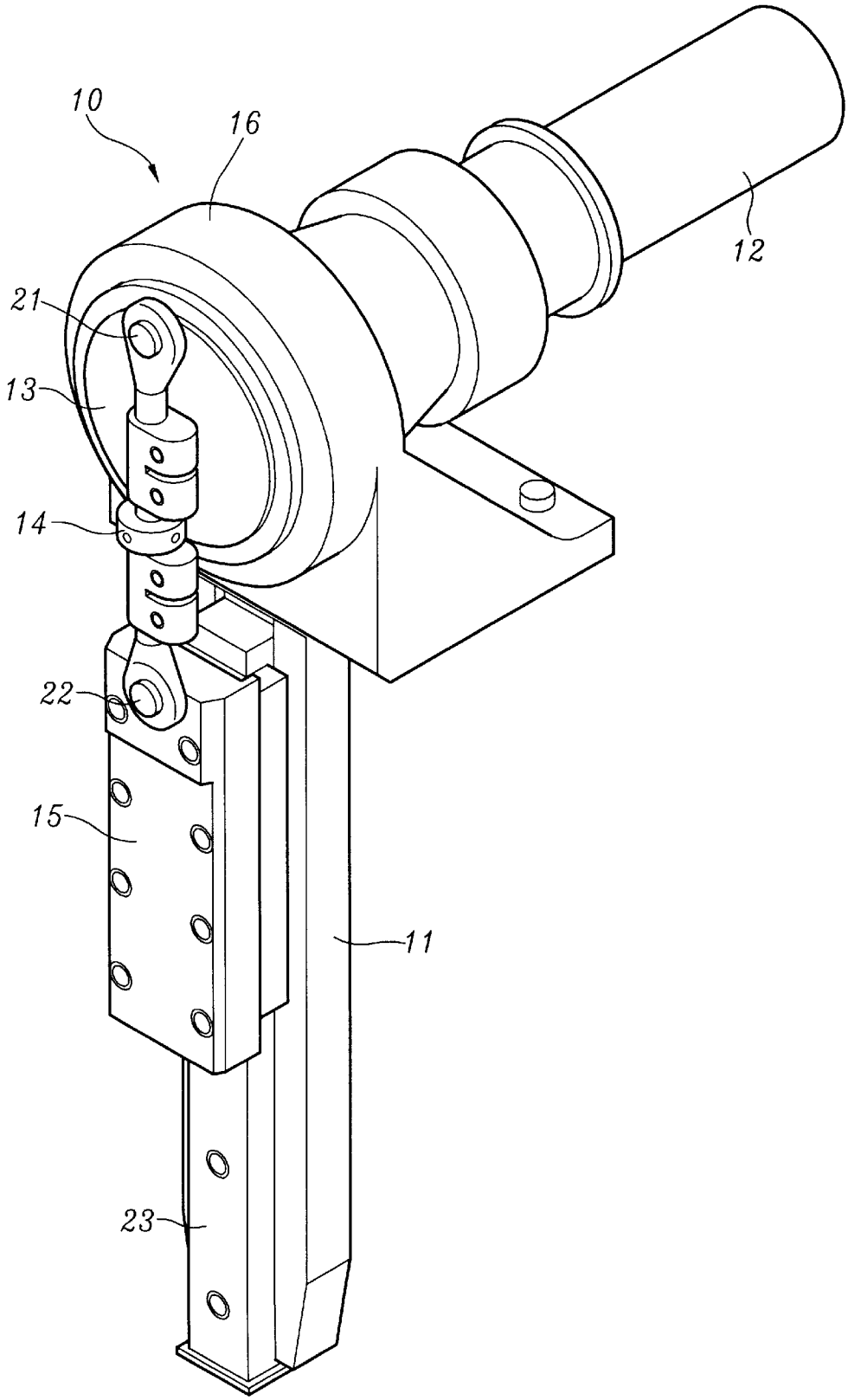
FIG. 2 is a perspective view of the present invention.
Figure 3:
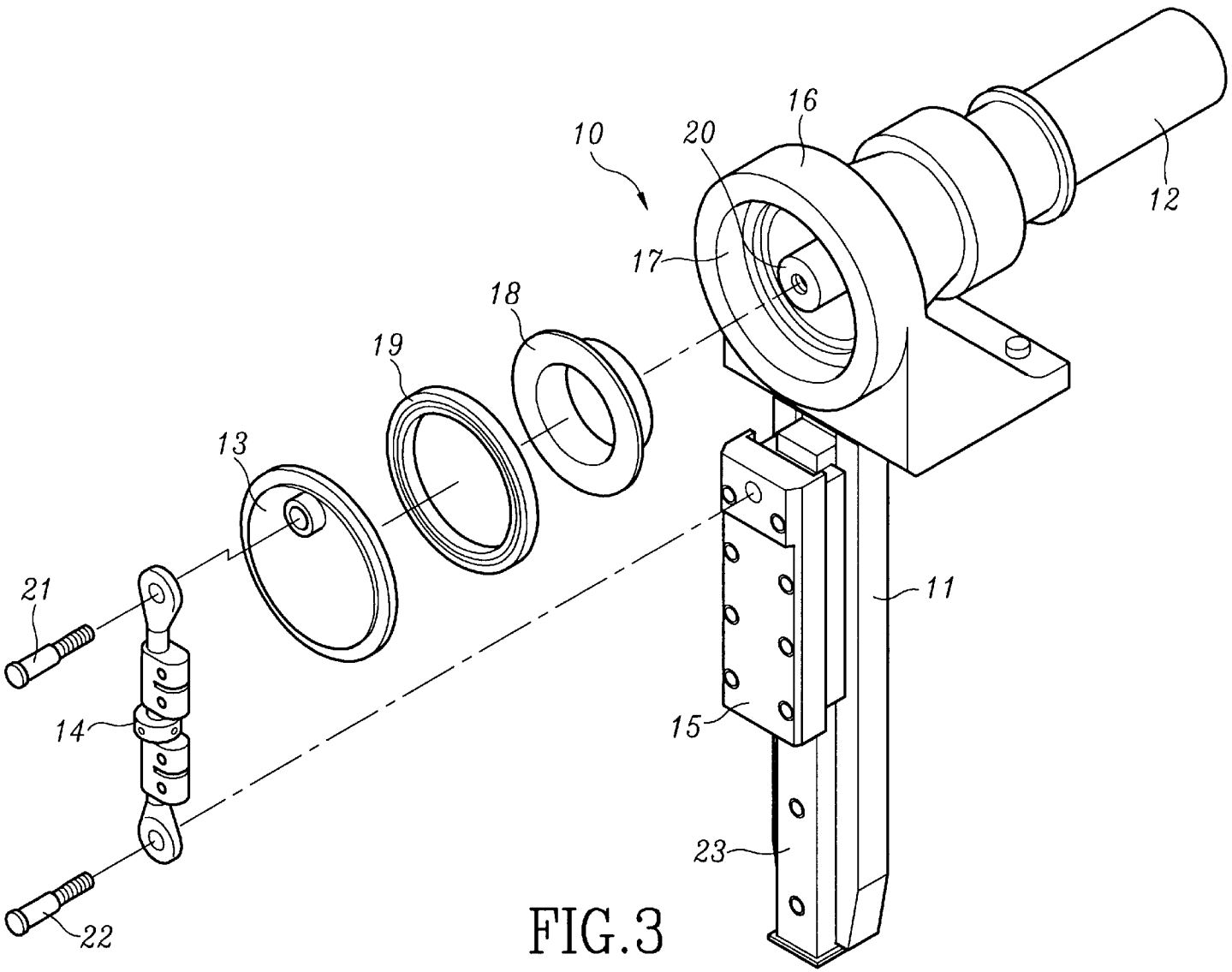
FIG. 3 is an exploded perspective view of the present invention.
Figure 5:
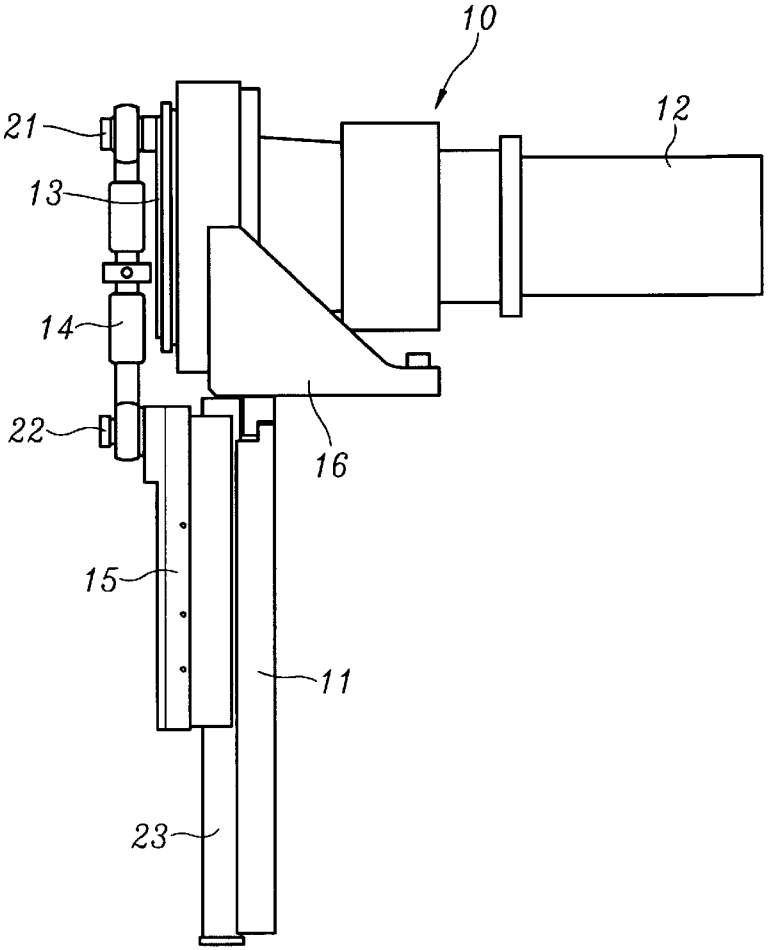
FIG. 5 is a lateral view of the present invention.
Figure 4:
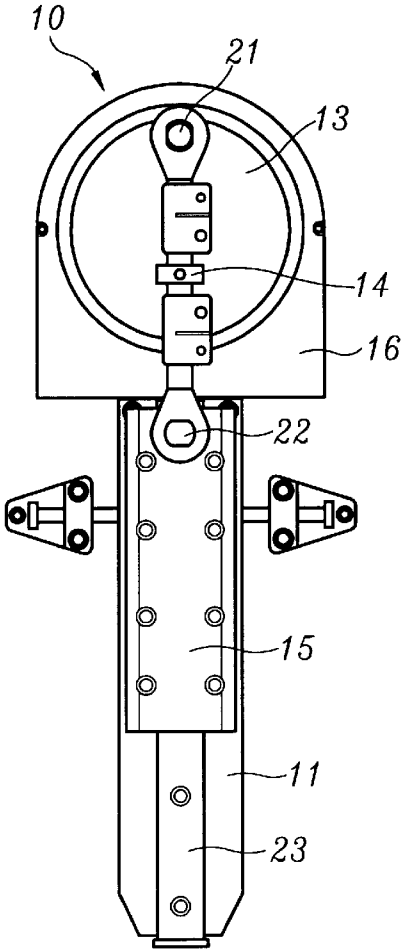
FIG. 4 is a front view of the present invention.
Figure 6:
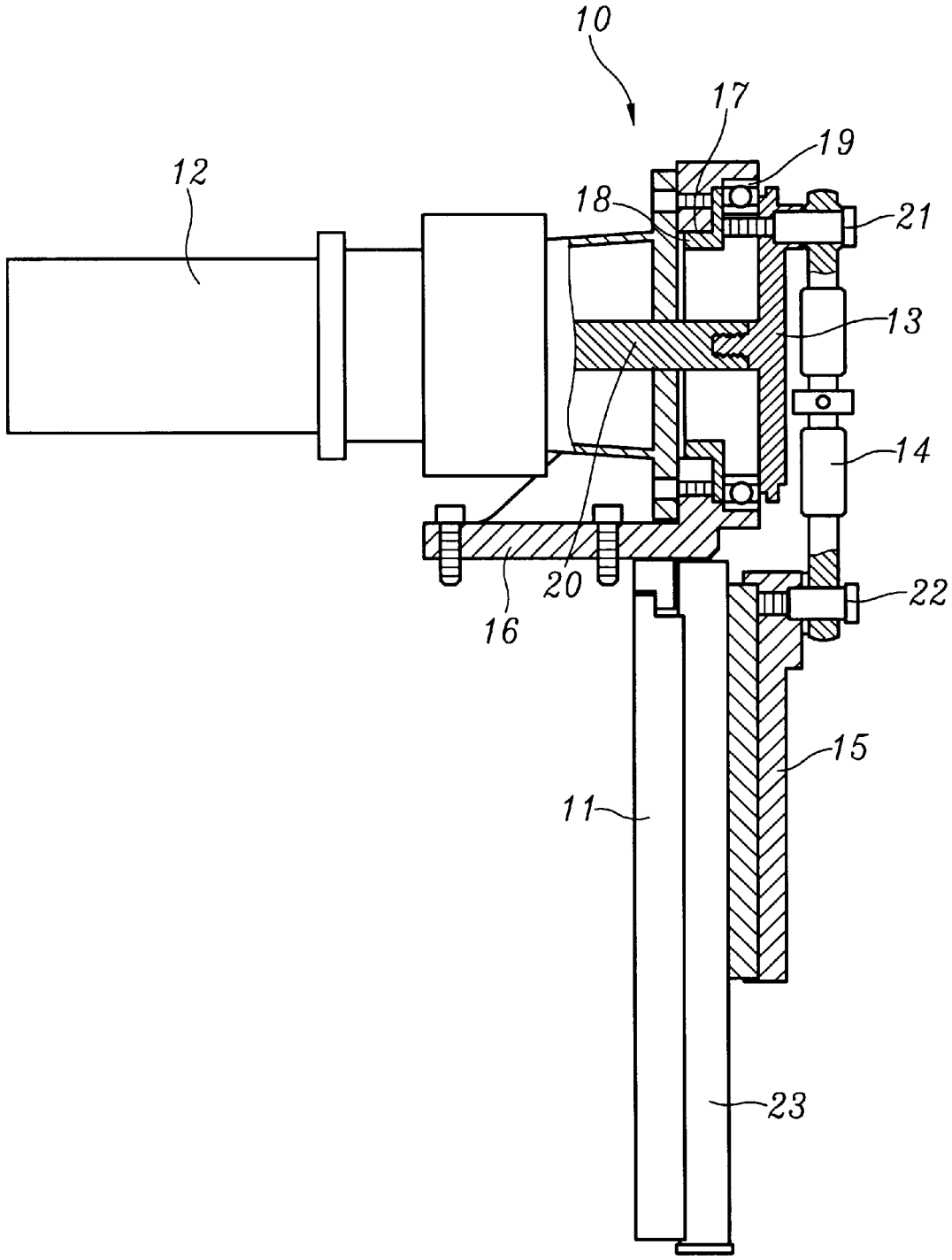
FIG. 6 is partial cross sectional view of the present invention.
Figure 7:
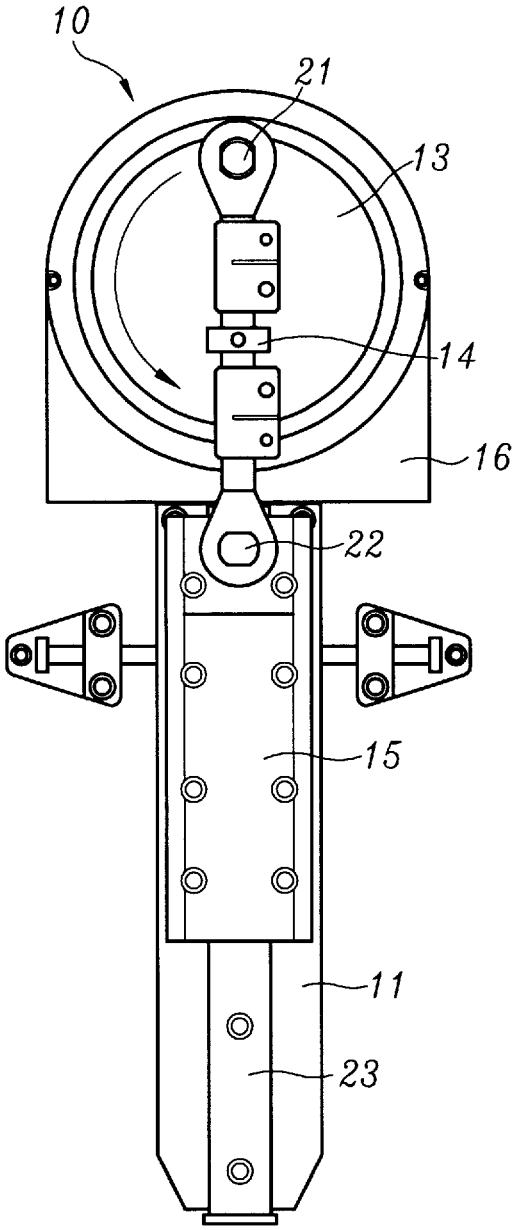
FIG. 7 is a schematic view of the present invention.
Figure 8:
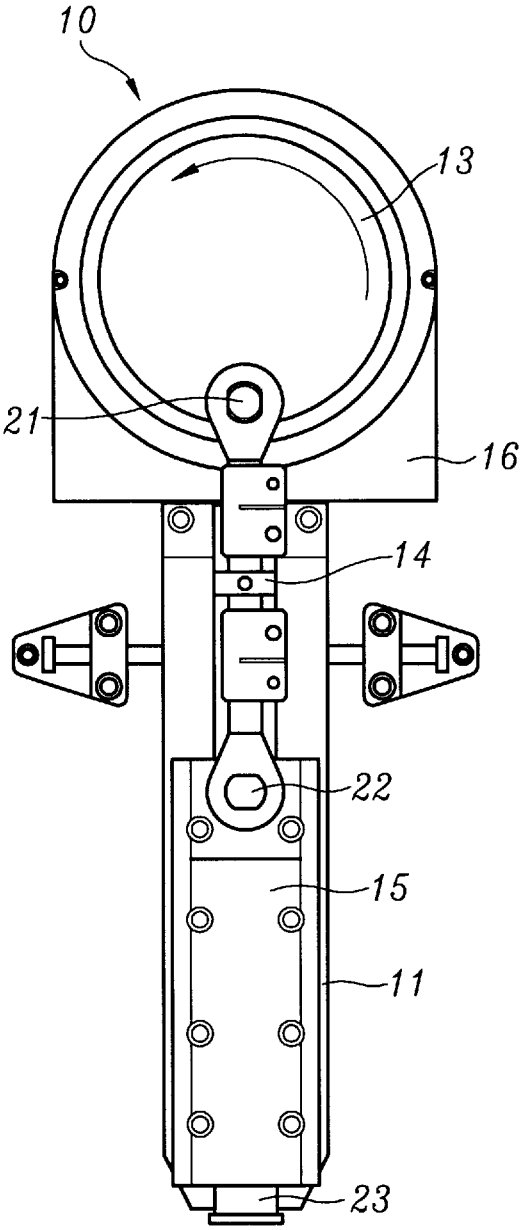
FIG. 8 is a schematic view showing the action of the present invention.

A wire (not shown) to be finished can be output from a wire output axial center 31 (as shown in FIG. 9). Then a servo motor 12 serves to drive the receiving tank 13 to rotate (as shown in FIGS. 7 and 8), then the receiving tank 13 drive the knife seat 15 through a linkage 15 so to move upwards and downwards, and further to drive the shaping knife to move upwards and downwards so that the wire outputted from the wire output axial center 31 is shaped by being ejected by the shaping knife so that it can be used to be as the component for manufacturing a spring, etc.

In the present invention, a receiving tank 13 and a linkage 14 form as a linkage means so as to drive the shaping knife to move upwards and downwards, which has a stroke almost equal to the diameter of the rotary wheel 13. The larger stroke has a smaller turning diameter. Thus, only a smaller size is sufficient. Therefore, the whole adjusting means has a smaller volume. Moreover, the defects in the prior art cam, such as material and time consuming, and expensive in cost, are not present in the present invention. Moreover, in the present invention, the rotary wheel 13 and the linkage 14 have simple structures and needs lower precision. Therefore, manufacturing cost is lowered.

Although the present invention has been described using specified embodiment, the examples are meant to be illustrative and not restrictive. It is clear that many other variations would be possible without departing from the basic approach, demonstrated in the present invention.

What is claimed is:

1. A shaping device of a wire bending machine formed by a plurality of shaping means, each shaping means comprising:

a seat fixed to the wire bending machine, and installed with a track;

a motor fixed to the seat;

a rotary wheel connected to the motor and being driven to rotate by the motor;

a linkage one end of which is pivotally connected to an eccentric position of the rotary wheel;

a knife seat slidably matched to the track of the seat, another end of the linkage being pivotally couple to the knife seat.

2. The shaping device of a wire bending machine as claimed in claim 1, wherein the motor is fixed to a motor frame, the motor frame is fixed to the seat, a round receiving tank is installed in front of the motor frame, a bearing seat and a bearing are received with the receiving tank, and the rotary wheel is in contact with the bearing.

3. The shaping device of a wire bending machine as claimed in claim 1, wherein the sliding track is vertically installed at the front lateral side of the seat.

4. The shaping device of a wire bending machine as claimed in claim 1, wherein one end of the linkage is pivotally connected to an eccentric position on the rotary wheel by a first pivotally connecting element, another end of the linkage is pivotally connected to the knife seat by a second pivotally connecting element.

* * * * *